United States Patent [19]

Bogucki-Land

[11] Patent Number: 4,669,159

[45] Date of Patent: Jun. 2, 1987

[54] ARRANGEMENT FOR THE STRETCHING AND WARPING OF WARP THREADS

[75] Inventor: Bogdan Bogucki-Land, Offenbach am Main, Fed. Rep. of Germany

[73] Assignee: Karl Mayer Textilmaschinenfabrik GmbH, Fed. Rep. of Germany

[21] Appl. No.: 567,504

[22] Filed: Jan. 3, 1984

[30] Foreign Application Priority Data

Aug. 6, 1983 [DE] Fed. Rep. of Germany ..... 3328449

[51] Int. Cl.[4] ..... D02H 3/00; D02J 1/22

[52] U.S. Cl. ..... 28/185; 28/172; 28/241

[58] Field of Search ..... 28/172, 178, 179, 185, 28/241, 242, 246, 186, 187; 219/388 S; 34/41, 49; 26/6

[56] References Cited

U.S. PATENT DOCUMENTS

| | | | |
|---|---|---|---|
| 3,364,587 | 1/1968 | Norton et al. | 219/388 S X |
| 3,701,268 | 10/1972 | Treptow et al. | 28/179 X |
| 3,732,395 | 5/1976 | David | 219/388 S |
| 4,407,767 | 10/1983 | Seaborn | 28/178 X |
| 4,513,516 | 4/1985 | Bjornberg | 34/41 |

FOREIGN PATENT DOCUMENTS

| | | | |
|---|---|---|---|
| 0143466 | 6/1985 | European Pat. Off. | 28/240 |
| 1236128 | 3/1967 | Fed. Rep. of Germany . | |
| 2155514 | 5/1973 | Fed. Rep. of Germany . | |
| 2725348 | 12/1978 | Fed. Rep. of Germany . | |
| 3018373 | 11/1981 | Fed. Rep. of Germany | 28/172 |
| 3311777 | 10/1984 | Fed. Rep. of Germany | 28/185 |
| 1381334 | 11/1964 | France . | |
| 7729618 | 4/1979 | France . | |
| 883613 | 12/1961 | United Kingdom . | |

*Primary Examiner*—Robert R. Mackey
*Attorney, Agent, or Firm*—Omri M. Behr

[57] ABSTRACT

In an arrangement for the stretching and warping of thermoplastic warp threads, in particular polyester threads, there is provided an arrangement comprising a set of feeding rollers, a heating arrangement and a set of take-off rollers. The latter set of rollers has a higher circumferential speed than the former. Between the two sets of rollers there is provided at least one deflecting roller. The circumferential surface of this deflecting roller is divided into a heatable section and a relatively non-heatable section. The deflecting roller is rotatable from an operating position, in which the deflecting surface comprises the heatable surface portion, into a rest position wherein the deflecting surface presented is the non-heatable portion. In this way, the length of the thread exposed to heat can be extended between the feeding and take-off rollers without overheating of thread during the stopping of the arrangement. Other aspects of the mode of the process are also described herein.

22 Claims, 10 Drawing Figures

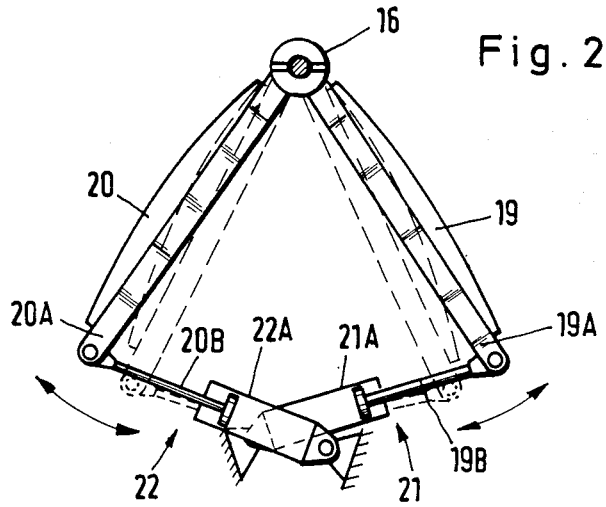
Fig. 2a
Fig. 4a
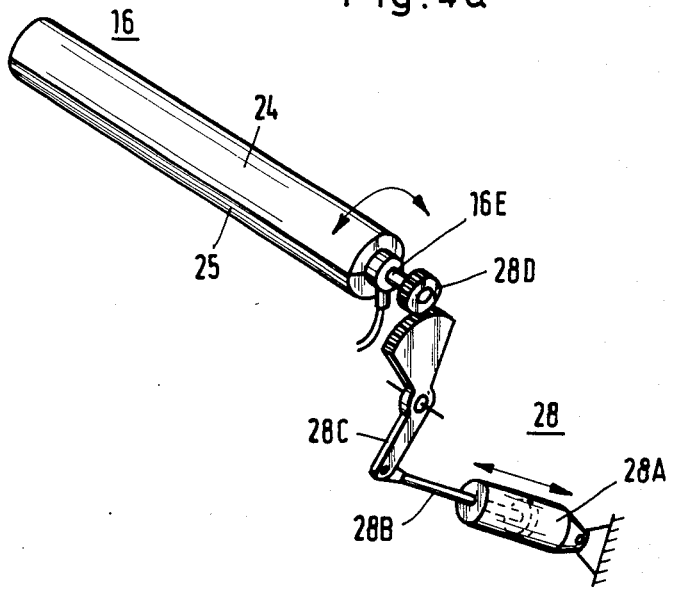

ARRANGEMENT FOR THE STRETCHING AND WARPING OF WARP THREADS

FIELD OF THE INVENTION

The present invention relates to apparatus and methods for heat stretching of warp threads.

BACKGROUND OF THE INVENTION

Arrangements are known for the stretching and warping of thermoplastic warp thread, especially polyester thread, comprising a set of feed rollers, a heating arrangement and a set of take-off rollers which rotate at a greater circumferential speed than the feed rollers.

In such an arrangement (French public application No. 77,29618), prestretched polyester threads are taken from spools on a creel and combined as a thread sheet. These are then passed through a heating oven located between the feed rollers and the take-off rollers and are thereafter wound onto a warp beam. Since the free thread length between the two roller arrangements cannot exceed a certain length (otherwise the thread sheet cannot pass through the oven in a clearly defined path) the length of the oven is thus limited. In order to provide a sufficient amount of heat to the thread, the oven must be run at a comparatively high temperature. In the event the arrangement is stopped, for example, in consequence of a broken thread, the warp sheet segment in the oven is overheated. Even if this does not lead to the tearing of threads, nevertheless there occurs a certain inhomogeneity in the thread sheet which can, for example, lead to a different level of dye acceptance in a subsequent dyeing process.

A further arrangement for the formation and delivery of stretched synthetic ribbon material is disclosed in German published application No. 27,25,348. In this arrangement, a film of synthetic material is provided from a supply roller and is sliced in the longitudinal direction. The thus formed ribbons are led through a warming segment located between two sets of rollers and subsequent thereto they are utilized in a textile machine. The warming segment comprises a set of three heatable rollers. The ribbons are led around a portion of the circumference of these rollers. Regrettably, in this arrangement when the machine stops, the ribbons in the heating segment become overheated.

It is further known (Kettenwerk Praxis 3/76, pages 15–17) to slice a sheet of synthetic material in a longitudinal direction and to heat the thus formed ribbons by means of a heating plate placed between two sets of rollers, to stretch the ribbons and thereafter to warp the stretched ribbons on a warp beam. The heating plate can be moved from the operating position into an at-rest position activated by one of the ribbons. The ribbons have a width of at least one millimeter so that the separation between the two sets of rollers may be chosen to be a little bit larger than in a stretching arrangement for pre-stretched yarn.

SUMMARY OF THE INVENTION

An arrangement for the stretching and warping of warp threads, according to the principles of the present invention, has a feed roller means. This feed roller means can drive the warp threads. The arrangement also includes a take-off roller means positioned downstream of the feed roller means for driving the warp threads received from the feed roller means. This take-off roller means has a greater circumferential speed than the feed roller means. Also included is a heating device positioned between the take-off and feed roller means for heating the threads. The arrangement also has at least one deflecting means positioned between the take-off and feed roller means to contact the warp threads. This deflecting means includes a heatable and relatively non-heatable segment. This arrangement also includes an actuator for repositioning the deflecting means and presenting to the warp threads the heatable and the non-heatable segment when the arrangement is in an operative and non-operative condition, respectively.

By employing apparatus of the foregoing type, the extended length of the thread sheet between the feeding and the take-off roller arrangements can be increased without affecting the threads when the machine has to stop.

Overheating is avoided in that there is provided at least one turning or deflecting means between the sets of rollers which comprises a circumferential surface divided into a heatable and non-heatable surface portion. A device controlling the deflecting means presents the heatable surface during operation of the arrangement and the non-heatable portion during the at-rest situation.

A method, also according to the principles of the same invention, for stretching and warping warp threads employs a reciprocatable and a rotatable heater, each movable between an active and inactive position. One step of the method is passing the warp threads across the reciprocatable and rotatable heaters with each in the active position, to heat the threads. Another step is warping the warp threads. Another step of the method is stopping the warping and contemporaneously moving the reciprocatable and rotatable heaters to the inactive position to cease actively heating the warp threads.

BRIEF DESCRIPTION OF THE DRAWINGS

In order that the invention may be more fully understood, it will now be described, by way of example, with references to the accompanying drawings in which:

FIG. 2*a* is a detailed, elevational view of the mechanism for moving the deflecting roller of FIG. 1;

FIG. 4*a* is a downward perspective view of the roller of FIG. 3 and its associated mechanical linkage;

DESCRIPTION OF THE PREFERRED EMBODIMENTS

Figure 1:
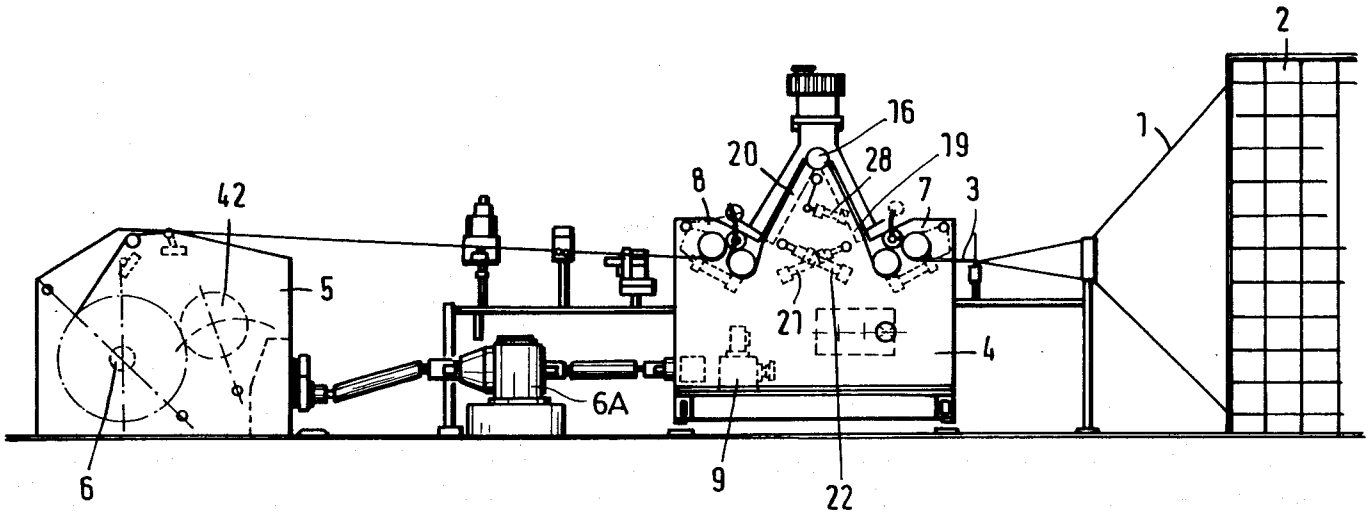
FIG. 1 is an elevational view of an entire stretching and warping arrangement according to the principles of the present invention.

In accordance with FIG. 1., prestretched synthetic threads 1, suitably of polyester thread, are pulled from spools on creel 2 and brought together as a thread sheet 3. The threads are heated in stretching zone 4 and thus stretched and finally warped onto beam 6 by warping arrangement 5. Warping arrangement 5 receives warp threads 1 in parallel and wraps them about warp beam 6.

In the stretching zone within frame 4 there is provided a set of staggered feed rollers 7 and a set of staggered take-off rollers 8. Rollers 7 and 8 are rotatably mounted in frame 4 with parallel axes. Common drive motor 9 mounted in frame 4 serves to drive the beam 6 through drive train 6A and to drive the two roller sets 7 and 8 through the appropriate linkages (shown hereinafter).

It is advantageous to provide that the sets of rollers 7 and 8 and the warping arrangement 5 are coupled to a common drive source 9. Thus when the power is cut to the warping arrangement 5 (for example, when threads break) the feeding and take-off rollers 7 and 8 are also halted.

Figure 2:
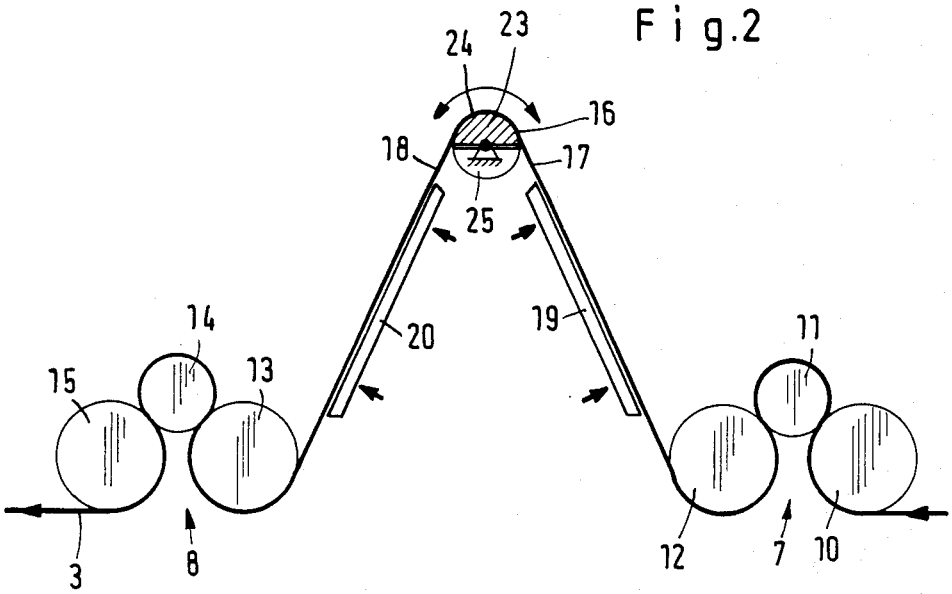
FIG. 2 is a cross-sectional elevational view of the stretching zone of FIG. 1 during the warping stretch.

As they are illustrated in FIG. 2, the feed roller set 7 comprises feed rollers 10 and 12, both tangent to smaller roller 11. The take-off roller set 8 comprises take-off rollers 13 and 15, both tangent to smaller roller 14. Between these two sets 7 and 8, deflecting roller 16 is provided in such a manner that a third segment 17 of the thread sheet is provided between roller set 7 and deflecting roller 16 and a second segment 18, between deflecting roller 16 and roller set 8.

Figure 3:
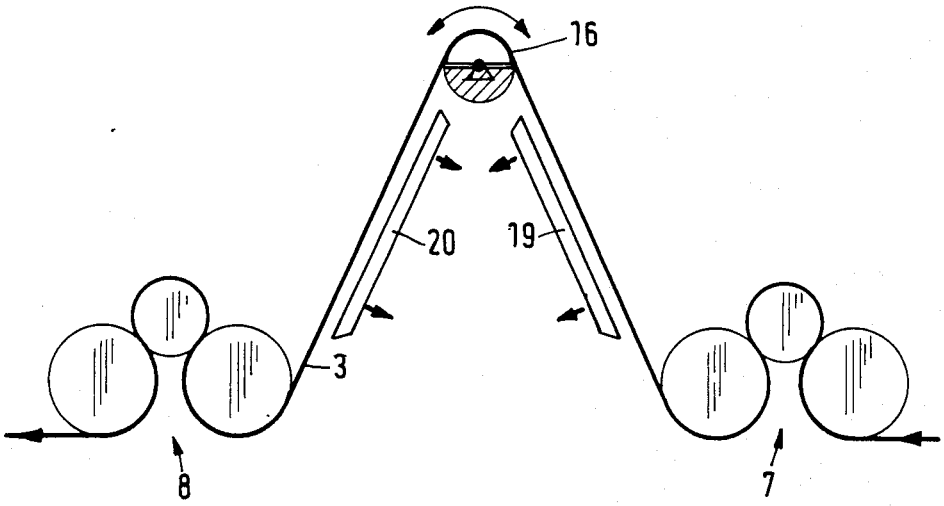
FIG. 3 is a cross sectional, elevational view of the arrangement of FIG. 2 during the stop stage.

Planar heating arrangements 19 and 20, are provided to each segment 17 and 18, respectively. These heating arrangements may be moved from their active position as shown in FIG. 2 into their at-rest position as shown in FIG. 3 by means of control arrangements 21 and 22 (FIG. 1) which are shown hereinafter in further detail. Heaters 19 and 20 may be hot plates heated electrically or by a circulating heating fluid described hereinafter.

It is advantageous to provide at least one substantially planar heating arrangement such as heater 19 and 20 to the segments 17 and 18 of the thread immediately prior to and immediately subsequent to deflecting roller 16. Such a planar heating arrangement operates with a positioning means (shown hereinafter) which will move the heating means from a position of proximity to the threads during the operating stage to a more distant position when the entire arrangement is at rest. This arrangement will prevent overheating of the threads when the equipment is at-rest.

It is advantageous to further provide that at least one of the planar heating arrangements 19 or 20 is swingably mounted in such a way that during the operating stage, heat can impinge differentially upon the warp sheet in such a manner that the amount of heat provided to the thread sheet can be readily controlled in order to take into account the nature of the thread material and its speed through the arrangement.

It is furthermore advantageously provided that the heating arrangement 19 before the deflecting roller 16 is so arranged that the warp threads reach the desired stretching temperature just after the last deflecting roller 16. This then provides the entire section between the deflecting roller 16 and the take-off roller set 8 to enable the stretching to occur. Such slow stretching leads to a superior molecular orientation over quick stretching and thus to more desirable thread properties.

The subsequently provided heating arrangement 20 should be set to provide approximately twice the amount of heat provided by the prior heating arrangement 19. Thus, the actual stretching takes place under further intensive provision of heat.

It is advantageous to provide the spatial relationship between the deflating roller 16, and the feed and take-off roller sets 7 and 8 in such a manner that the plane of the thread sheet 17 fed to deflecting roller 16 subtends an angle to the plane of the sheet 18 turned by the deflecting roller 16. Such angling saves space in the heating zone. This arrangement further engenders a certain amount of air turbulence so that heat losses due to smooth air flow along the surface of the thread sheets do not occur. It is particularly desirable to provide that the angle between feed sheet 17 and take-off sheet 18 is smaller than 90°. Referring to FIG. *2a*, the mechanism for moving heaters 19 and 20 is given. The operating position is shown in full lines, the non operating position in phantom. Coaxially pivoted at roller 16 are the upper ends of support plates 19A and 20A which support heaters 19 and 20, respectively. Pivotally connected to the lower ends of plates 19A and 20A are connecting rods 19B and 20B, respectively. Rods 19B and 20B are part of the piston mechanism of hydraulic actuators 21A and 22A, respectively, which may be pressurized to outwardly drive their respective rods when the arrangement is in an operative condition. Actuators 21A and 22A are pivotally mounted at their inside ends to the frame.

Figure 4:
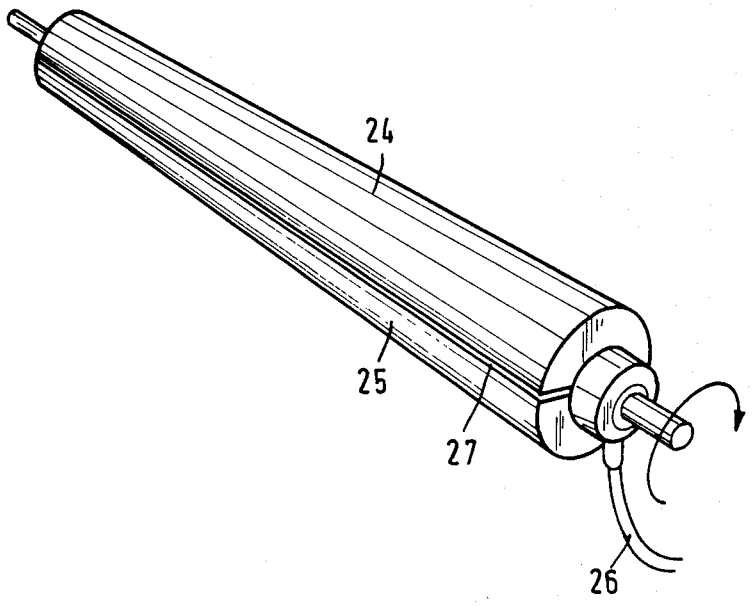
FIG. 4 is a downward perspective view of the deflecting roller of FIG. 1.

As is illustrated in FIG. 4, deflecting roller 16 is provided with an upper, semicylindrical portion connected to a heating arrangement 23, which heats the said upper portion having an upper surface 24. The lower, semicylindrical portion has an unheatable surface 25. The heating can be achieved by means of a heat carrier which feeds a heating fluid through line 26 at one end which is taken out of the other end in a similar manner. In order to provide for the thermal isolation of the two roller portions, they are divided by a split region 27 which may, if desired, be provided with a layer of thermal insulating material. The heatable surface 24 is rough and is suitably made of chromium or ceramic while the unheatable surface portion 25 is smooth. This deflecting roller 16 can be rotated 180° about trunions 16E by means of a turning arrangement 28 (FIG. 1), so that it moves out of the operating position illustrated in FIG. 2 to the at-rest position illustrated in FIG. 3.

By utilizing at least one deflecting roller 16, the thread sheet is supported between feed roller set 7 (FIG. 2) and take-off roller set 8. The thread sheet 3 is securely led, however, and it may be subjected to the influence of heating over a greater length. It should further be noted that a very intensive transfer of heat occurs on the heated surface of the deflecting roller 16 since the threads are presented tightly against the surface during the passing thereover. Notwithstanding this effect, there is no danger to the thread in the case of a stoppage since at such time, deflecting roller 16 is turned 180° into the at-rest position and thread sheet 3 then rests on an unheated surface. The greater length of the thread sheet 17 and 18 between the roller sets 7 and 8 permits either the thread sheet to pass with greater speed through the heatable stretching zone or, under preservation of the usual speed, to operate at higher temperatures so that under certain circumstances an overheating of the thread during stoppage of the arrangement can be avoided.

Referring to FIG. 4*a*, deflecting roller 16 is shown coupled to drive 28 for the rotation of deflecting roller 16. Roller 16 is immediately turned at machine stop because a stop command for the warping machine also gives the corresponding activation signal to hydraulic actuator 28A of roller 16. Connecting rod 28B is pivotally connected to one end of rocker 28C whose other end terminates in a toothed sector meshing with spur gear 28D on the end of trunion 16E. By controlling this rotation via actuator 28A, and by providing a stopper means (not shown) it is quite simple to limit the rotational movement of deflecting roller 16 to 180°. Since modern warping machines run at approximately 600 meters per minute and about 0.3 seconds are required from stop signal to actual stop, a certain amount of thread, suitably about 3–4 meters, will run over roller 16 and this provides sufficient time to turn the roller around 180°. Thus there is no danger that the threads end up half and half across surface 24–25. Deflecting roller 16 only has two permanent positions namely the running position of the at-rest position, that is to say, there is no continuous adjusting of rotation involved.

Figure 5:
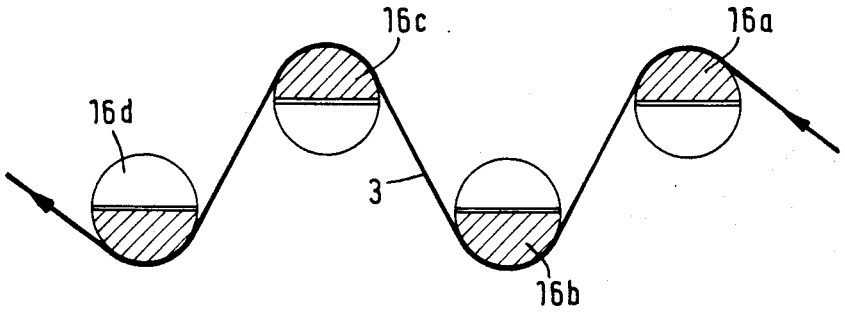
FIG. 5 is a schematic, cross-sectional, end view of a stretching arrangement which is an alternate to the single deflecting roller system of FIG. 2.
Figure 6:
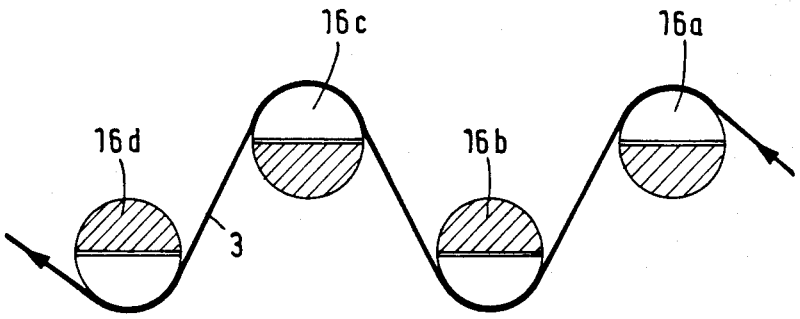
FIG. 6 is a similar view of the arrangement of FIG. 5 during the stop of the warping arrangement.

As is shown in FIGS. 5 and 6, plurality of staggered deflecting rollers 16*a* through 16*d* may be supplied sequentially, about which the thread sheet 3 is partially wrapped in order to obtain the desired warming of the thread sheet 3. Each roller 16*a*–16*d* is constructed the same as deflecting roller 16 (FIG. 4*a*). When the arrangement is brought to a halt the several rollers 16*a*–16*d* must be brought from the operative position of FIG. 5 to the at-rest position of FIG. 6. The mechanism for rotating each of the rollers 16*a*–16*d* is substantially as was shown in FIG. 4*a*.

Figure 7:
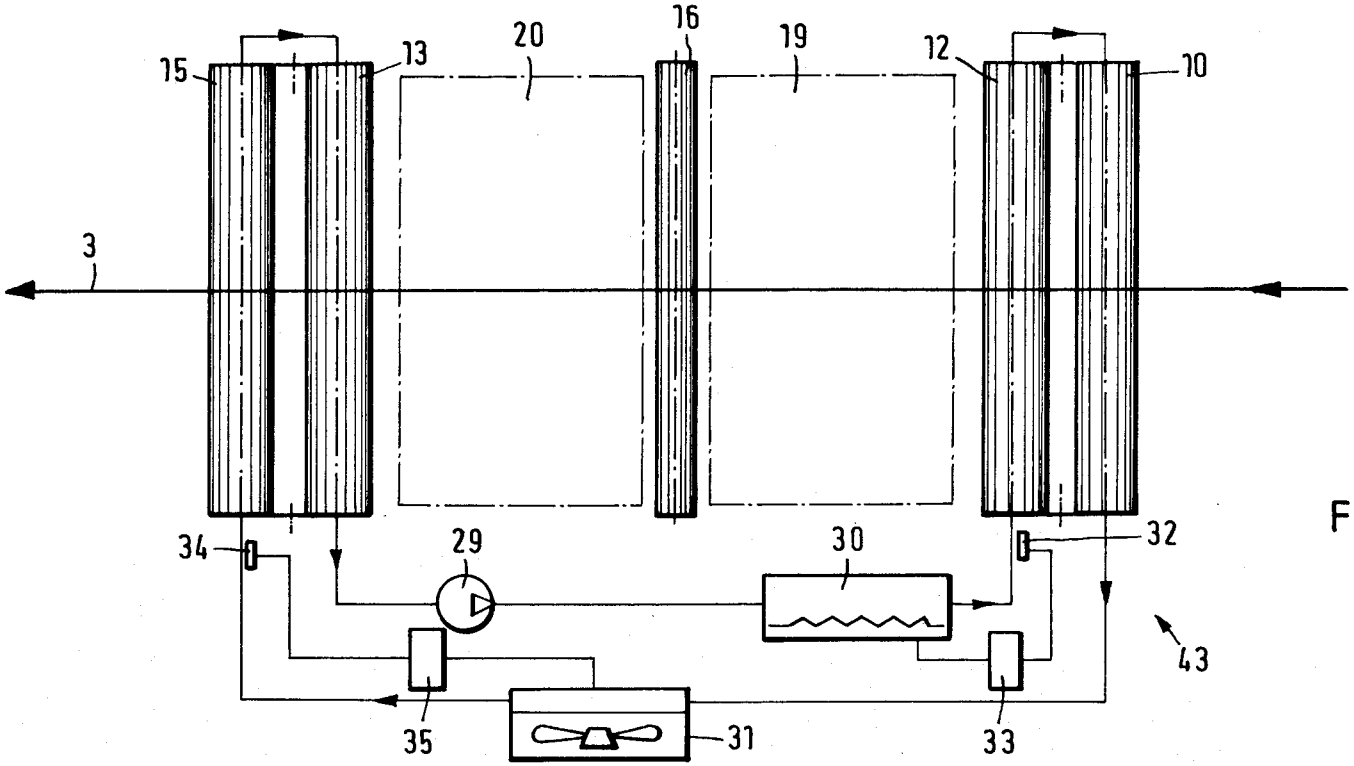
FIG. 7 is a schematic plan view of the warming and cooling circuits for the rollers of FIG. 1.

Referring to FIG. 7, previously mentioned feed rollers 10 and 12 are heated and take-off rollers 13 and 15 are cooled, all of these rollers being hollow. For this purpose a common heating fluid circuit 43 is contemplated in which a fluid which may be oil or water is circulated by means of pump 29. The circuit comprises a heating arrangement 30 providing a fluid flow through the internal space in rollers 10 and 12. Accordingly, pump 29 feeds serially to heater 30 and to the serial combination of hollow rollers 12 and 10 which return to cooling arrangement 31. Cooling arrangement 31 may operate with cooling fan or, if required, conventional refrigeration apparatus to reduce the temperature of the fluid passing therethrough. Cooling arrangement 31 delivers fluid through the hollow inner space of serially connected take-off rollers 15 and 13, returning to pump 29. Sensor module 32 at the input point of roller 12 activates controller 33 of the heating arrangement 30. A further sensor 34 located at the input point of roller 15 activates controller 35 for the cooling arrangement 31. In this way the heating and cooling temperatures of the roller systems are economically held at the desired temperature.

Figure 8:
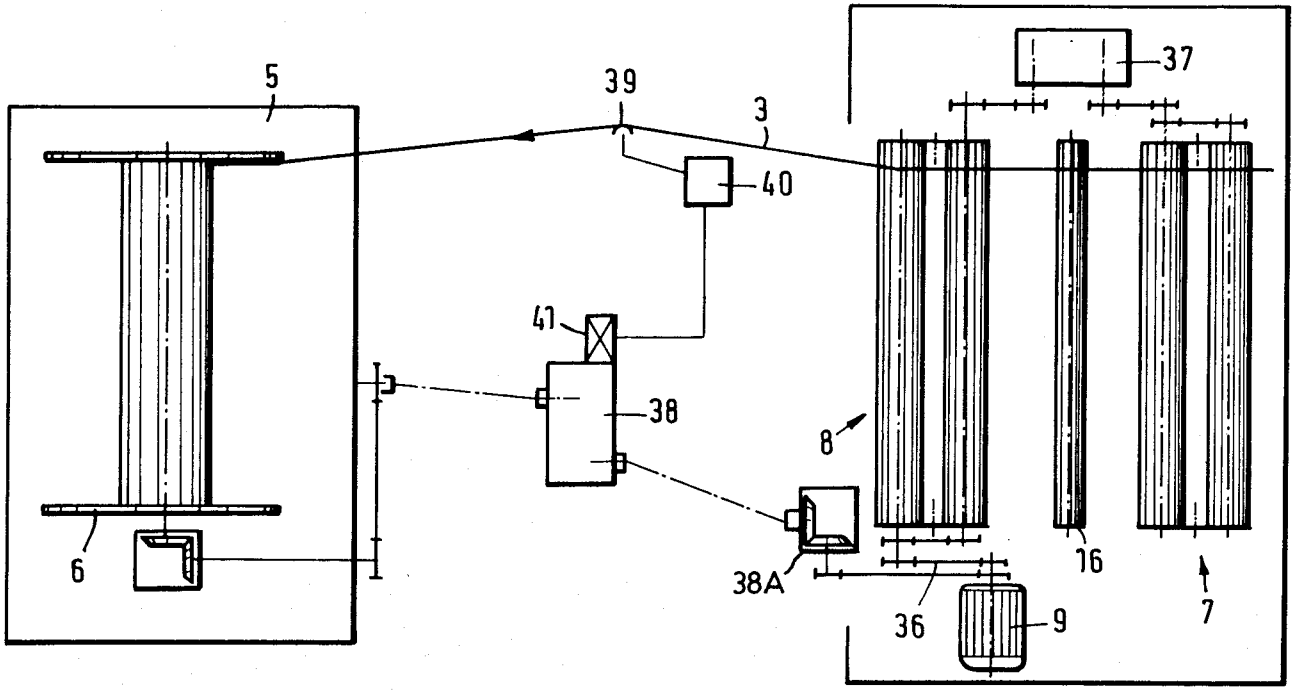
FIG. 8 is a schematic plan view of the stretching and warping arrangement of FIG. 1.

Referring to FIG. 8, the mechanical drive system may be established as schematically shown therein. Motor 9 drives take off roller set 8 via gearing system 36 which in turn is connected with feeding roller set 7 by a further reduction gear system 37 which runs approximately 50% slower than take-off roller system 8. Warp beam 6 of warping system 5 is driven from motor 9 through bevel gear arrangement 38A and stepless gear drive 38. For well understood reasons, at the commencement of the warping process, the rate of rotation of the warp arrangement is higher than that at the end of the warping process at which time the beam diameter is at its maximum, so that the rate of thread uptake is constant. Gear drive 38 may be a variable transmission having side-by-side conical elements with opposing apexes, the connection between them being varied by actuator 41 which is controlled by electrical controller 40. Controller 40 senses thread speed by transducer 39. Control is effected by transducer contact bar 39 which is connected to the setting member 41 of the stepless drive 38 via control means 40. Alternativley, the winding speed can be controlled by the assistance of a contact roller 42 as shown in center on FIG. 1. The warping speeds in such an arrangement can go as high as 800 meters per minute.

It has been found advantageous to first put the heating portions into operation and after a short delay time activate the roller arrangements 7 and 8 and finally, dependent upon the increasing speed of the thread sheet, deflecting roller 16 is set into its operating position and finally planar heating units 19 and 20 are activated. In this manner, the already slowly running thread sheet is brought to the temperature necessary for stretching. In operation, deflecting roller 16 is positioned as shown in FIG. 2 by the action of actuator 28A (FIG. 4*a*). At this time heaters 19 and 20 are against the threads as shown in FIG. 2 due to the extension of actuators 21A and 22A.

Also, at this time, it is desirable if take-off rollers 13 and 15 are cooled by the action of arrangement 31 (FIG. 7). This enables heat to be applied until immediately before the take-off roller set and at the same time provide that a stable sheet of treads issues from the take-off rollers. The heating circuit through arrangement 30 and pump 29 serves to provide heat to feeding rollers 10 and 12 returning to cooling arrangement 31 and take-off rollers 13 and 15. In this manner, both the heating and cooling energy requirements can be held to a minimum.

During operation, thread sheet 3 passes from creel 2 through delivery rollers 10 and 12, is warmed by them and then heated by planar heating arrangement 19.

It is advantageous to provide that the feeding roller set 10, 12 comprises at least one heatable roller. This, thus, provides a certain amount of preheat to the warp threads before they actually reach the heating zone. On the other hand, however, the temperature may be held so low that during stopping of the arrangement, no negative impact upon the threads will occur. The highest temperature transfer to the thread sheet occurs on deflecting roller 16 where heating due to heating arrangement 23 and frictional heating due to the sliding of the thread on the rough upper surface 24 occurs.

The heatable surface portion of roller 16 is provided with an upper surface which is so rough that when the threads pass thereover they are heated as a result of frictional interaction. Such heating, of course contributes to the overall heating of the threads without the necessity of raising the environmental temperature. The actual stretching occurs at the deflecting roller 16, suitably however, shortly thereafter. This stretching occurs under a further warming influence by the planar heating means 20 whose radiation is approximately twice as high as that of the heating arrangement 19. By means of a built in temperature regulator, the temperature of this heating arrangement can be held constant. The thus stretched threads are cooled on take-off rollers 13 and 15 and can then be readily taken up on warp beam 6.

The stretching between the take-off rollers 8 and the warp beam 6 further serves to cool the threads.

The arrangement for the drive of the above described system is characterized in that at the same time that the warping machine is halted, the roller system is also halted, deflecting roller 16 being rotated into the at-rest position and the planar heating modules 19 and 20 being positioned into their at-rest position. In this manner, even in an arrangement which runs at high speed and therefore utilizes higher temperature, insurance is provided against overheating of the threads during a sudden stop. When the arrangement must suddenly halt, motor 9 is halted and the roller sets 7 and 8 as well as warp beam 6 no longer rotate and at the same time turning roller 16 is rotated by 180°. The latter rotation is accomplished by actuator 28A. The two planar heating devices 19 and 20 are moved into the at-rest position (FIG. 3) by actuators 21A and 22A. In this way, the heat impinging upon the threads is cut by approximately 90°. Thus it is not possible for the threads to become overheated.

Moreover, the unheated portion of the surface of roller 16 is made of a material having as low a coefficient of friction as possible so that when the device is in the at-rest position, the frictional impact is substantialy minimized.

Upon restart of the equipment, planar heating arrangements 19 and 20 are again moved proximate to the thread sheet 3 and deflecting roller 16 is turned by 180°. These parts can then be raised to the appropriate temperature. It is only then that the motor is restarted.

Obviously, many modifications and variations of the present invention are possible in light of the above teachings. It is, therefore, to be understood that within the scope of the appended claims, the invention may be practiced otherwise than as specifically described.

What I claim is:

1. Arrangement for the stretching and warping of warp threads comprising:

a feed roller means for driving said warp threads;

a take-off roller means for driving said warp threads received from said feed roller means, said take-off roller means having a greater circumferential speed than said feed roller means;

a heating device positioned between said take-off and feed roller means for heating said threads;

at least one deflecting means rotatable about an axis, comprising a curved surface, the axis of said deflecting means being disposed perpendicular to the plane of curvature of said curved surface positioned between said take-off and feed roller means to contact said warp threads, said deflecting means including a heatable and relatively non-heatable segment, wherein said heatable segment has a coefficient of friction sufficiently high to cause heating of said threads by a predetermined amount when passing over said heatable segment due to the driving influence of said take-off and feed roller means;

means coupled to said heatable segment for conducting heat to it;

motive means for rotating said deflecting means about said axis and for presenting to said warp threads said heatable and said non-heatable segment when said arrangement is in an operative and non-operative condition, respectively, said heating device comprising a heater mounted alongside said deflecting means to reciprocate with respect to said warp threads, said heating being operable to move into proximity to and away from said warp threads in response to said arrangement being in an operative and inoperative condition, respectively;

control means for activating said motive means; and take up means for said treated threads.

2. An arrangement according to claim 1 wherein said non-heatable segment has a lower coefficient of friction than said heatable segment.

3. An arrangement according to claim 1 wherein said heater comprises:

a pair of heating elements, one located upstream, the other downstream of said deflecting means.

4. An arrangement according to claim 3 wherein at least one of said heating elements at said heater is swingable into a heating position when said arrangement is in an operative condition, said heating position being adjustable to vary the heat flowing into said warp threads.

5. An arrangement according to claim 3 wherein the downstream one of said heating elements is set to cause said warp threads to reach a predetermined stretching temperature shortly after passing said deflecting means.

6. An arrangement according to claim 3 wherein said downstream one of said heating elements delivers approximately twice the amount of heat delivered by said upstream one of said heating elements.

7. An arrangement according to claim 1 wherein said feed roller means comprises:

at least one heatable roller; and means coupled to said heatable roller for conducting heat to it.

8. An arrangement according to claim 7 further comprising a closed circuit for circulating a thermal medium comprising:

a heating means for heating said medium and feeding it to said heatable roller;

a cooling means for cooling said medium and feeding it to said take-off roller means; and a circulating pump communicating with said heating and cooling means for circulating through them said thermal medium.

9. An arrangement according to claim 8 further comprising:

a first regulator means for sensing the output temperature of said heating means and regulating its output temperature toward a predetermined first temperature; and a second regulator means for sensing the output temperature of said cooling means and regulating its output temperature toward a predetermined second temperature.

10. An arrangement according to claim 1 wherein said take-off roller means comprises at least one coolable roller; and cooling means coupled to said coolable roller for conducting heat from it.

11. An arrangement according to claim 10 further comprising a closed circuit for circulating a thermal medium comprising:

a heating means for heating said medium and feeding it to said heatable roller; and a circulating pump communicating with said heating and cooling means for circulating through them said thermal medium.

12. An arrangement according to claim 1 wherein the relative placement of said take-off and feed roller means with respect to said one deflecting means causes said warp threads to leave said feed roller means at a different angle than said warp threads entering said take-off roller means.

13. An arrangement according to claim 12 wherein the angle between said warp threads leaving said feed roller means and said warp threads entering said take-off roller means is acute.

14. An arrangement according to claim 1 wherein said take-off roller means comprises:

a warping means downstream of said take-off roller means for receiving a winding of said warp threads; and a common drive means for driving said warping means, said take-off roller means and said feed roller means.

15. An arrangement according to claim 1 wherein said at least one deflecting means comprises:

a plurality of staggered rollers, said warp threads being threaded between them.

16. An arrangement according to claim 15 wherein each of said staggered rollers has a heatable and relatively non-heatable segment.

17. Arrangement for the stretching and warping of warp threads comprising:

a feed roller means for driving said warp threads;

a take-off roller means for driving said warp threads received from said feed roller means, said take-off roller means having a greater circumferential speed than said feed roller means;

at least one deflecting means rotatable about an axis, comprising a curved surface, the axis of said deflecting means being disposed perpendicular to the plane of curvature of said curved surface positioned between said take-off and feed roller means to contact said warp threads, said deflecting means including a heatable and relatively non-heatable segment;

means coupled to said heatable segment for conducting heat to it;

motive means for rotating said deflecting means about said axis and for presenting to said warp threads said heatable and said non-heatable segment when said arrangement is in an operative and non-operative condition, respectively;

a heating device mounted alongside said deflecting means and positioned between said take-off and feed roller means for heating said threads, comprising a pair of heating elements, one located upstream, the other downstream of said deflecting means, wherein the upstream one of said heating elements has the capacity to provide to said threads a predetermined amount of heat, said upstream one of said heating elements being arranged and set to provide said predetermined amount of heat and cause said warp threads to reach a predetermined stretching temperature shortly after passing said deflecting means;

means for reciprocating said heating elements with respect to said warp threads, said heating elements being operable to move into proximity to and away from said warp threads in response to said arrangement being in an operative and inoperative condition, respectively;

control means for activating said motive means; and take up means for said treated threads.

18. Arrangement for the stretching and warping of warp threads comprising:

a feed roller means for driving said warp threads;

a take-off roller means for driving said warp threads received from said feed roller means, said take-off roller means having a greater circumferential speed than said feed roller means;

at least one deflecting means rotatable about an axis, comprising a curved surface, the axis of said deflecting means being disposed perpendicular to the plane of curvature of said curved surface positioned between said take-off and feed roller means to contact said warp threads, said deflecting means including a heatable and relatively non-heatable segment;

means coupled to said heatable segment for conducting heat to it;

a heating device mounted alongside said deflecting means and positioned between said take-off and feed roller means for heating said threads, comprising a pair of heating elements, one located upstream, the other downstream of said deflecting means, said pair of heating elements having the relative capacity to allow the downstream one of said heating elements to provide twice the amount of heat to said threads as the upstream one, wherein the upstream one of said heating elements is set to provide approximately half the amount of heat delivered by said downstream one of said heating elements;

means for reciprocating said heating device with respect to said warp threads, said heating device being operable to move into proximity to and away from said warp threads in response to said arrangement being in an operative and inoperative condition, respectively;

motive means for rotating said deflecting means about said axis and for presenting to said warp threads said heatable and said non-heatable segment when said arrangement is in an operative and non-operative condition, respectively;

control means for activating said motive means; and take up means for said treated threads.

19. Arrangement for the stretching and warping of warp threads comprising:

a feed roller means for driving said warp threads wherein said feed roller means comprises at least one heatable roller;

a take-off roller means for driving said warp threads received from said feed roller means, said take-off roller means having a greater circumferential speed than said feed roller means, wherein said take-off roller means comprises at least one coolable roller;

a heating device positioned between said take-off and feed roller means for heating said threads;

means for reciprocating said heating device to move into proximity to and away from said warp threads in response to the arrangement being in an operative and inoperative condition, respectively;

at least one deflecting means rotatable about an axis, comprising a curved surface, the axis of said deflecting means being disposed perpendicular to the plane of curvature of said curved surface positioned between said take-off and feed roller means to contact said warp threads, said deflecting means including a heatable and relatively non-heatable segment;

means coupled to said heatable segment for conducting heat to it;

motive means for rotating said deflecting means about its axis for presenting to said warp threads said heatable and said non-heatable segment when said arrangement is in an operative and non-operative condition, respectively;

control means for activating said motive means; and take up means for said treated threads; and further comprising:

a closed circuit for circulating a thermal medium comprising:

(a) a heating means operable to heat said medium and feed it to said heatable roller;

(b) a cooling means for cooling said medium and feeding it to said take-off roller means for cooling said coolable roller;

(c) a circulating pump communicating with said heating and cooling means for circulating through them said thermal medium;

(d) a first regulator means for sensing the output temperature of said heating means and regulating its output temperature toward a predetermined first temperature; and (e) a second regulator means for sensing the output temperature of said cooling means and regulating its output temperature toward a predetermined second temperature.

20. Arrangement for the stretching and warping of warp threads comprising:

a feed roller means for driving said warp threads;

a take-off roller means for driving said warp threads received from said feed roller means, said take-off roller means having a greater circumferential speed than said feed roller means;

a heating device positioned between said take-off and feed roller means for heating said threads;

means for reciprocating said heating device to move into proximity to and away from said warp threads in response to the arrangement being in an operative and inoperative condition, respectively;

at least one deflecting means rotatable about an axis, comprising a curved surface, the axis of said deflecting means being disposed perpendicular to the plane of curvature of said curved surface positioned between said take-off and feed roller means to contact said warp threads, said deflecting means including a heatable and relatively non-heatable segment;

means coupled to said heatable segment for conducting heat to it;

motive means for rotating said deflecting means about its axis for presenting to said warp threads said heatable and said non-heatable segment when said arrangement is in an operative and non-operative condition, respectively;

control means for activating said motive means; and take up means for said treated threads comprising:

(a) warping means for receiving a winding of said warp threads; and (b) a common drive means for driving said warping means, said take-off roller means and said feed roller means.

21. Arrangement for the stretching and warping of warp threads comprising:

a feed roller means for driving said warp threads;

a take-off roller means for driving said warp threads received from said feed roller means, said take-off roller means having a greater circumferential speed than said feed roller means;

a heating device positioned between said take-off and feed roller means for heating said threads;

means for reciprocating said heating device to move into proximity to and away from said warp threads in response to the arrangement being in an operative and inoperative condition, respectively;

at least one deflecting means rotatable about an axis, comprising a curved surface, the axis of said deflecting means being disposed perpendicular to the plane of curvature of said curved surface positioned between said take-off and feed roller means to contact said warp threads, said deflecting means including a heatable and relatively non-heatable segment, said at least one deflecting means comprising a plurality of staggered rollers, said warp threads being threaded between them;

conducting means coupled to said heatable segment for conducting heat to it;

motive means for rotating said deflecting means about its axis for presenting to said warp threads said heatable and said non-heatable segment when said arrangement is in an operative and non-operative condition, respectively;

control means for activating said motive means; and take up means for said treated threads.

22. An arrangement according to claim 21 wherein each of said staggered rollers has a heatable and relatively non-heatable segment, said conducting means being operable to conduct heat to said heatable segment.

* * * * *